US010971318B2

(12) United States Patent
Sakai

(10) Patent No.: US 10,971,318 B2
(45) **Date of Patent: *Apr. 6, 2021**

(54) ELECTRIC CIRCUIT BREAKER DEVICE

(71) Applicant: DAICEL CORPORATION, Osaka (JP)

(72) Inventor: Toshiyuki Sakai, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/639,930

(22) PCT Filed: Sep. 6, 2018

(86) PCT No.: PCT/JP2018/032961

§ 371 (c)(1),
(2) Date: Feb. 18, 2020

(87) PCT Pub. No.: WO2019/054262

PCT Pub. Date: Mar. 21, 2019

(65) Prior Publication Data

US 2020/0194204 A1 Jun. 18, 2020

(30) Foreign Application Priority Data

Sep. 15, 2017 (JP) ..... JP2017-177772

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC . H01H 39/00; H01H 39/006; H01H 2039/008
See application file for complete search history.

(56) References Cited

U.S. PATENT DOCUMENTS 6,222,439 B1 4/2001 Tanigawa et al.
6,556,119 B1 * 4/2003 Lell ..... H01H 37/323 337/157

(Continued)

FOREIGN PATENT DOCUMENTS

JP 11-232979 A 8/1999
JP 2012-138281 A 7/2012

(Continued)

*Primary Examiner* — Jacob R Crum
(74) *Attorney, Agent, or Firm* — Birch, Stewart, Kolasch & Birch, LLP.

(57) ABSTRACT

An electric circuit breaker device includes in a housing, an igniter, a rod-like projectile, and a conductor portion configured to form a portion of an electric circuit disposed in a cylindrical space formed in the housing; and an insulating closed space formed between a second end portion of the housing and the conductor portion. The conductor portion is a plate portion having first and second connection portions at opposing ends and a cut portion in an intermediate portion between the first and second connection portions. A surface of the cut portion is orientated orthogonal to the housing axial direction; the rod-like projectile is disposed aligned with a surface of the cut portion in the housing axial direction; and a width (W1) of the insulating closed space and a width (W2) of an end portion of the rod-like projectile have relationships W1>W2 and W1−W2≤0.25 mm.

2 Claims, 3 Drawing Sheets

(56) References Cited

U.S. PATENT DOCUMENTS

| | | | | |
|---|---|---|---|---|
| 2005/0083164 | A1 | 4/2005 | Caruso et al. | |
| 2005/0083165 | A1 | 4/2005 | Tirmizi | |
| 2007/0034491 | A1* | 2/2007 | Knauss | H01H 39/006 200/61.08 |
| 2012/0234162 | A1 | 9/2012 | Tirmizi | |
| 2013/0056344 | A1 | 3/2013 | Borg | |
| 2013/0263714 | A1* | 10/2013 | Ukon | B23D 15/145 83/639.1 |
| 2013/0263715 | A1 | 10/2013 | Ukon et al. | |
| 2014/0061161 | A1 | 3/2014 | Nakamura et al. | |
| 2015/0206681 | A1* | 7/2015 | Marlin | H01H 39/00 200/82 R |
| 2016/0351364 | A1* | 12/2016 | Fukuyama | H01H 39/006 |
| 2017/0221662 | A1 | 8/2017 | Sakai | |

FOREIGN PATENT DOCUMENTS

| | | | |
|---|---|---|---|
| JP | 2013-522834 | A | 6/2013 |
| JP | 2014-49300 | A | 3/2014 |
| JP | 2016-85947 | A | 5/2016 |

* cited by examiner

ELECTRIC CIRCUIT BREAKER DEVICE

TECHNICAL FIELD

The present invention relates to an electric circuit breaker device that can be used in an electric circuit of a vehicle, an electric home appliance, and the like.

BACKGROUND ART

An electric circuit breaker device that breaks an electric circuit is used to prevent significant damage when an abnormality occurs in an electric circuit or a system including the electric circuit of a vehicle, an electric home appliance, or the like. Electric circuit breaker devices for electric circuits of electric vehicles are becoming increasingly important. A known electric circuit breaker device includes, in a housing, an igniter, a projectile (piston), a conductor, and the like (US 2005/0083164 A, US 2005/0083165 A, US 2012/0234162 A, JP H11-232979 A, JP 2014-49300 A, JP 2016-85947 A, JP 2014-49300 A).

In US 2005/0083164 A, US 2005/0083165 A, metal, ceramic, and polymer are cited as examples of the material of a housing, and it is stated that a specific polymer is preferred (US 2005/0083164 A pages 2 to 3, US 2005/0083165 A page 2).

In JP H11-232979 A, a casing 13 is made of stainless steel (paragraph number 0011).

In JP 2014-49300 A, a case 30 has electric insulation properties, and is formed of a high-strength material (e.g., resin material) (paragraph number 0034). As can be seen from FIG. 1 and the like of US 2005/0083164 A, US 2005/0083165 A, and JP 2014-49300 A, when a polymer material (resin material) is used, a housing (casing) must be thick to ensure the required strength. When a casing 13 made of stainless steel is used, the mass is increased and an insulation case 14 is required to be a part of the assembly. This increases the complexity of the structure and assembly.

The technology of JP 2016-85947 A obtains an effect not found in US 2005/0083164 A, US 2005/0083165 A, US 2012/0234162A, JP H11-232979 A, and JP 2014-49300A by reinforcing a resin housing using a metal cylinder.

In the technology of JP 2014-49300A, an arc extinguishing chamber 32 is provided for extinguishing arcs caused when conductors conducting electricity are separated (claims).

SUMMARY OF INVENTION

A first embodiment of the present invention provides an electric circuit breaker device, comprising:

in a housing made of synthetic resin, an igniter, a rod-like projectile made of synthetic resin, and a conductor portion configured to form a portion of an electric circuit disposed in a cylindrical space formed in the housing in this order from a first end portion side toward a second end portion side opposite the first end portion side in a housing axial direction; and an insulating closed space formed between a second end portion of the housing and the conductor portion; wherein the conductor portion is a plate portion comprising a first connection portion and a second connection portion at opposing ends and a cut portion in an intermediate portion between the first connection portion and the second connection portion, a surface of the cut portion being orientated orthogonal to the housing axial direction;

the rod-like projectile is disposed aligned with a surface of the cut portion of the conductor portion in the housing axial direction; and a width (W1) of the insulating closed space and a width (W2) of an end portion of the rod-like projectile have relationships $W1>W2$ and $W1-W2\leq 0.25$ mm.

A second embodiment of the present invention provides an electric circuit breaker device, comprising:

in a housing made of synthetic resin, an igniter, a rod-like projectile made of synthetic resin, and a conductor portion configured to form a portion of an electric circuit disposed in a cylindrical space formed in the housing in this order from a first end portion side toward a second end portion side opposite the first end portion side in a housing axial direction; and an insulating closed space formed between a second end portion of the housing and the conductor portion; wherein the conductor portion is a plate portion comprising a first connection portion and a second connection portion at opposing ends and a cut portion in an intermediate portion between the first connection portion and the second connection portion, a surface of the cut portion being orientated orthogonal to the housing axial direction;

the rod-like projectile is disposed aligned with a surface of the cut portion of the conductor portion in the housing axial direction; and a width (W1) of the insulating closed space and a width (W2) of an end portion of the rod-like projectile have relationships $W1<W2$ and $W2/W1\leq 1.05$.

BRIEF DESCRIPTION OF DRAWINGS

The present invention will be more fully understood from the detailed description given hereinbelow and the accompanying drawings, which are given for explanation only and do not limit the present invention.

DESCRIPTION OF EMBODIMENTS

Figure 1:
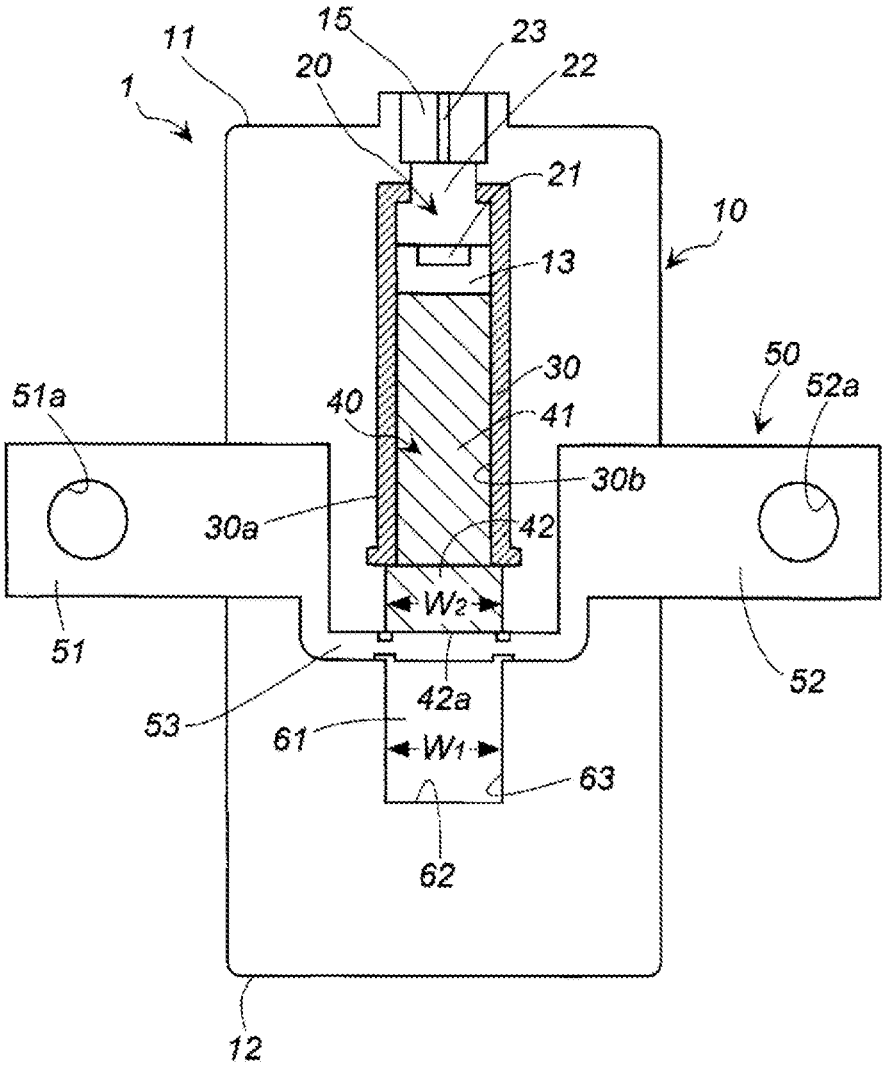
FIG. 1 is a cross-sectional view in an axial direction of an electric circuit breaker device according to an embodiment of the present invention.

The present invention provides an electric circuit breaker device that can extinguish arcs caused when a conductor portion is cut.

An electric circuit breaker device according to the present invention is used in an electric circuit for a battery (lithium ion battery or the like) of a gasoline or diesel vehicle, an electric home appliance, and the like. The electric circuit breaker device is configured to interrupt the electric circuit.

An electric circuit breaker device of the present invention can be installed independently in vehicles such as those described above, or can be installed and cooperate together with an airbag device in a vehicle. In such a case, when the vehicle with the airbag device is involved in an accident, the electric circuit breaker device of the present invention receives an activation signal of the airbag device and also activates, interrupting the electric circuit. This prevents large amounts of current leakage.

A housing is made of synthetic resin and includes a cylindrical space formed from a first end portion side toward a second end portion side on the opposite side from the first end portion side in a housing axial direction. The cylindrical space on the second end portion side and an insulating closed space are connected, but divided by a conductor portion. The external shape of the housing is appropriately selected according to an attachment portion. The housing has a shape, structure, and size that allows components such as the igniter, the projectile, and the conductor portion to be housed and installed therein. The housing may also include a first housing from the first end portion to the portion where the conductor portion is disposed and a second housing (bottom clip) from the portion where the conductor portion is disposed to the second end portion.

The igniter may be a known igniter used in electric circuit breaker devices or may be an igniter for a gas igniter used in an airbag device in a vehicle. The igniter includes an ignition portion including an ignition charge and a conduction pin for conducting electricity. At the time of actuation, the igniter combusts the ignition charge by applying electric power from an external power source, and generates combustion products such as combustion gas and flames.

A rod-like projectile receives the pressure from the combustion product produced when the igniter activates, moves within the housing in the axial direction, and interrupts the electric circuit. The rod-like projectile may have an overall constant outer diameter (equal width), or the end portion may be larger or smaller than the other portions. The end portion of the rod-like projectile preferably has a quadrangular prism shape (quadrangle in a plan view) or a square prism shape to facilitate cutting by the conductor portion. The rod-like projectile may be made the same synthetic resin as the housing.

The conductor portion may be a conductor portion used in a known electric circuit breaker device. A conductor portion is a plate portion including connection portions (a first connection portion and a second connection portion) on opposite sides and a cut portion as an intermediate portion. The conductor portion is configured to form a portion of the electric circuit when the device is part of an electric circuit. The shape of the conductor portion is a plate-like shape corresponding to the shape and structure of the attachment portion to the housing.

In an electric circuit breaker device according to a first embodiment, a width (W1) of the insulating closed space of the housing and a width (W2) of an end portion of the rod-like projectile disposed in the insulating closed space have relationships W1>W2 and W1−W2≤0.25 mm, and preferably the inner diameter (W1) of the insulating closed space and the outer diameter (W2) of the end portion of the rod-like projectile having the relationships W1>W2 and W1−W2≤0.25 mm. Preferably W1−W2≤0.20 mm, and more preferably W1−W2≤0.10 mm. Note that in the case where the rod-like projectile has a constant outer diameter (even width), the width of the end portion of the rod-like projectile is the same as the width of the rod-like projectile.

In the electric circuit breaker device according to the first embodiment, the difference between the width (W1) of the insulating closed space and the width (W2) of the end portion of the rod-like projectile is minimal. Thus, when the device activates and the rod-like projectile is pushed and moves through the insulating closed space (i.e., slides along the inner wall surface of the insulating closed space), after the cut portion of the conductor portion is cut, the rod-like projectile together with the cut portion moves while sliding along the inner wall surface of the insulating closed space. By cutting the cut portion in this way, electricity is disconnected and the electric circuit is interrupted. Also, by the rod-like projectile moving while sliding against the inside of the insulating closed space, arcs can be prevented and any arcs caused can be quickly extinguished.

An electric circuit breaker device according to a second embodiment is the same as the electric circuit breaker device according to the first embodiment except that the width (W1) of the insulating closed space and the width (W2) of the end portion of the rod-like projectile have the relationships W1<W2 and W2/W1≤1.05. The width (W2) of the end portion of the rod-like projectile is slightly greater than the width (W1) of the insulating closed space, forming only a small gap between the rod-like projectile and the insulating closed space. As a result, when the device is activated and the cut portion of the conductor portion is cut, the rod-like projectile and the cut portion wobble slightly due in part to the impact when the cut portion was cut, and the rod-like projectile moves being pushed through the insulating closed space (i.e., sliding against the inner wall surface of the insulating closed space). By cutting the cut portion in this way, electricity is disconnected and the electric circuit is interrupted. Also, by the rod-like projectile moving while sliding against the inside of the insulating closed space, arcs can be prevented and any arcs caused can be quickly extinguished.

In the electric circuit breaker device of the present invention, the rod-like projectile moves in the cylindrical space inside the housing while sliding against the inner wall surface of the insulating closed space. Thus, when the conductor portion is cut, arcs are prevented or quickly extinguished.

Figure 2:
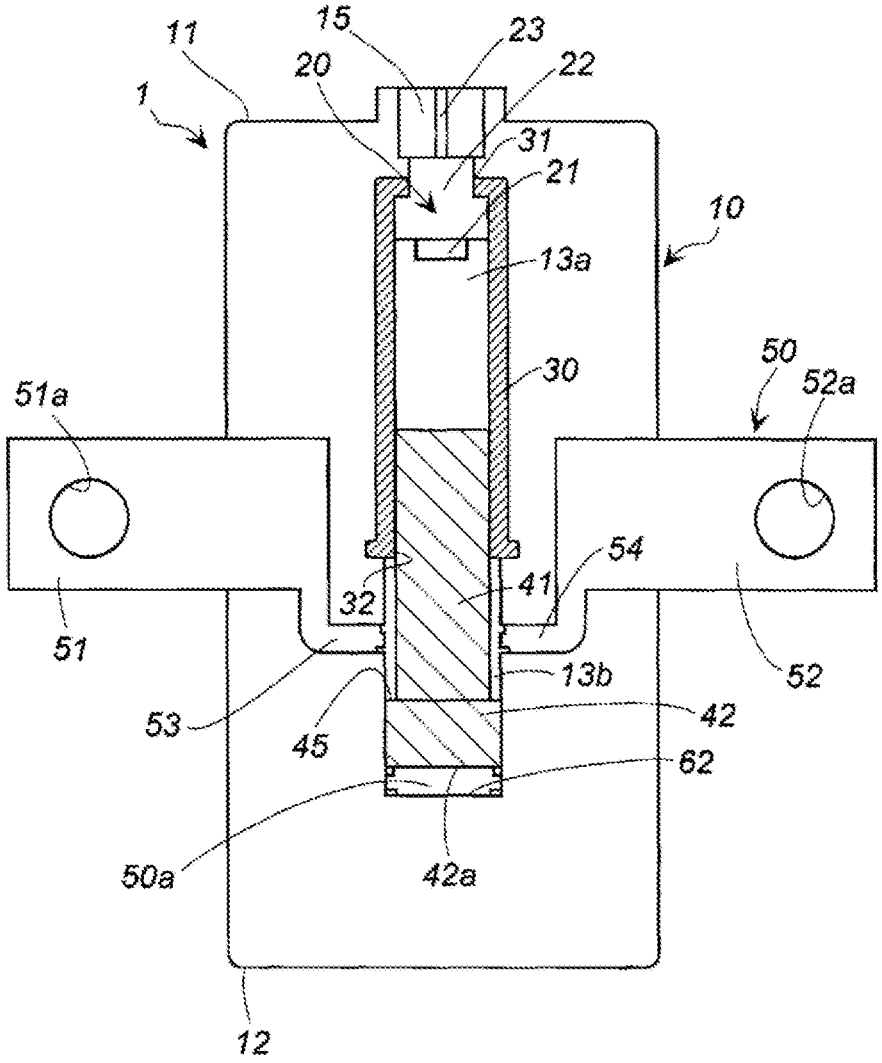
FIG. 2 is a cross-sectional view in an axial direction of an electric circuit breaker device according to an embodiment of FIG. 1 after actuation.

Embodiments of the Invention (1) Electric Circuit Breaker Device illustrated in FIG. 1 and FIG. 2

An electric circuit breaker device 1 according to an embodiment of the present invention will be described with reference to FIG. 1 and FIG. 2.

The housing (resin housing) 10 made of synthetic resin includes a cylindrical space 13 that extends from a first end portion 11 to a conductor portion 50 on a side where a second end portion 12 is located. The cylindrical space 13 includes a small diameter cylindrical space 13*a* on the first end portion side and a large diameter cylindrical space 13*b* on the second end portion side. The cylindrical space 13 has a shape that corresponds to the outer shape of a rod-like projectile 40. A connector fitting portion 15 connected to a power source by a lead wire when in operation is attached at the first end portion 11 side.

In the cylindrical space 13 of the housing 10, an igniter 20, the rod-like projectile 40 made of synthetic resin, and the conductor portion 50 are disposed in this order from the first end portion 11 side in the axial direction. The igniter 20 includes a resin portion 22 that covers a portion of an ignition portion main body including an ignition portion 21 and a conduction pin 23 integrally formed. The ignition portion 21 protrudes from the resin portion 22.

The rod-like projectile 40 illustrated in FIG. 1 may be the same as that illustrated in FIG. 1 and FIG. 2*a* in JP 2016-85947 A. The rod-like projectile 40 includes a rod portion 41 and an end increased diameter portion 42 formed at an end of the rod portion 41. The cross-sectional shape of the rod portion 41 in the housing width direction is a circle, and the cross-sectional shape of the end increased diameter portion 42 in the housing width direction is a square. The width (length of one side of the square) (W2) of the end increased diameter portion 42 is greater than the outer diameter of the rod portion 41, and an annular step surface 45 is formed at the boundary between the end increased diameter portion 42 and the rod portion 41. A narrowed portion with a smaller outer diameter is formed in a portion of the rod portion 41 where an O-ring can be installed.

A cylinder 30 illustrated in FIG. 1 is for reinforcing the housing 10 and can be made of a metal such as stainless steel or aluminum or a fiber reinforced resin such as carbon fiber reinforced resin. The thickness of the cylinder 30 varies depending on the size of the device 1, but preferably ranges from approximately 0.5 to approximately 3 mm. The cylinder 30 includes a first end opening portion 31 that is in contact with the resin portion 22 of the igniter 20 and a second end opening portion 32 on the opposite side that is in contact with the annular step surface 45 of the rod-like projectile 40. The cylinder 30 is disposed surrounding the ignition portion 21 of the igniter 20 and the rod portion 41 of the projectile 40. The cylinder 30 is forced into the cylindrical space 13, being fixed and unable to move in the axial direction.

The conductor portion 50 is configured to form a portion of an electric circuit when the device 1 is part of an electric circuit. The conductor portion 50 is a plate portion (has a plate-like shape) including a first connection portion 51 and a second connection portion 52 at opposing ends and a cut portion 53 in an intermediate portion between the first connection portion 51 and the second connection portion 52. The first connection portion 51 and the second connection portion 52 are configured to connect to other conductors in the electric circuit (e.g., a lead wire). The cut portion 53 is configured to be cut and interrupt the electric circuit when activated.

The conductor portion 50 is disposed with a surface of the cut portion 53 orientated orthogonal to the axial direction of the housing 10. The surface of the cut portion 53 of the conductor portion 50 faces an end surface 42*a* of the end increased diameter portion 42 of the projectile 40. In FIG. 1, the surface of the cut portion 53 and the end surface 42*a* are in contact with one another, but in another embodiment, the two may face each other with space in between.

An insulating closed space 61 is formed between the conductor portion 50 and the second end portion 12 of the housing. The insulating closed space 61 has a square cross-sectional shape in the housing width direction and includes an opening portion that opens to the conductor portion 50, a closed end surface 62 on the second end portion 12 side opposite from the opening portion in the housing axial direction, and four side surfaces 63.

A width (W1) of the insulating closed space 61 (space between opposing side surfaces 63) and a width (W2) of the end portion 42 of the rod-like projectile 40 have the relationships $W1>W2$ and $W1-W2\leq 0.25$ mm. Preferably $W1-W2\leq 0.20$ mm, and more preferably $W1-W2\leq 0.10$ mm.

A method of manufacturing the electric circuit breaker device illustrated in FIG. 1 includes placing the conductor portion in a mold and performing injection molding, then inserting the required components from one end of the cylindrical space 13. Another method include placing the conductor portion in a mold and performing injection molding, forming a first housing by inserting components up until the conductor portion 50 from the first end portion 11, inserting the required components from either end of the cylindrical space 13 and placing it back in the mold and performing injection molding again, and forming a second housing (bottom clip) from the portion up until the conductor portion 50 to the second end portion 12.

Next, the operation when the electric circuit breaker device 1 illustrated in FIG. 1 is disposed in a portion of an electric circuit of an electric vehicle will be described. The electric circuit breaker device 1 illustrated in FIG. 1, together with an abnormal-current detecting sensor and the like, can automatically actuate when an abnormal current flows through the electric circuit, and can also be actuated by a human action.

In a configuration in which the electric circuit breaker device 1 is disposed in an electric circuit, a hole 51*a* of the first connection portion 51 of the conductor portion 50 and a hole 52*a* of the second connection portion 52 are configured to connect to the lead wire that forms the electric circuit. When an abnormality occurs in the electric circuit, the igniter 20 activates and a combustion product is produced from the igniter portion 21. The ignition portion 21 is surrounded at the first end opening portion 31 of the cylinder 30. Thus, the produced combustion product travels through the cylinder 30 and impacts on the rod portion 41 of the rod-like projectile 40. The high temperature combustion product travels through the metal cylinder 30 and impacts on the rod-like projectile 40, with the inner wall surface of the cylindrical space 13 not being directly exposed to the heat and pressure of the combustion product.

The end increased diameter portion 42 of the rod-like projectile 40 that receives pressure from the combustion product moves in the axial direction and cuts the cut portion 53 of the conductor portion 50. Then, the end increased diameter portion 42 of the rod-like projectile 40 enters the insulating closed space 61 and, as illustrated in FIG. 2, travels while sliding against the side surfaces 63 of the insulating closed space 61 until the end increased diameter portion 42 and a cut piece 50*a* of the cut portion 53 reach the closed end surface 62 and held there in an electrically insulated manner. This action breaks the electric connection between the first connection portion 51 and the second connection portion 52 on either end of the conductor portion 50, and the electric circuit including the device 1 is interrupted. In the case where in this process the conductor portion 50 is cut and an arc is caused between the first connection portion 51 and the second connection portion 52, the arc is extinguished due to the end increased diameter portion 42 of the rod-like projectile 40 moving while sliding against the side surfaces 63 of the insulating closed space 61. Note that in an embodiment in which the width (W1) of the insulating closed space and the width (W2) of the end portion of the rod-like projectile has the relationships $W1<W2$ and $W2/W1\leq 1.05$, a similar effect is obtained by a similar action.

Figure 3:
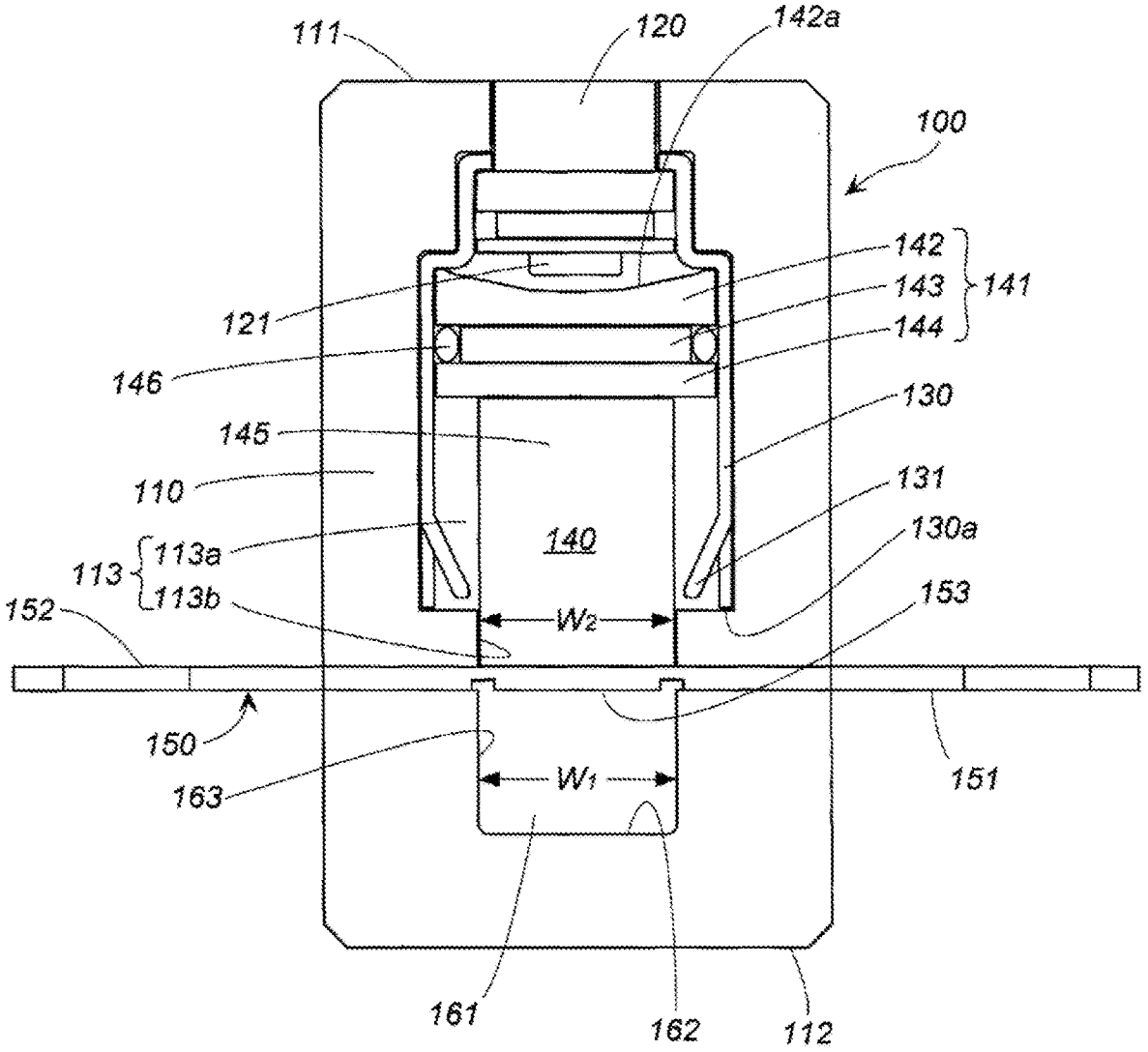
FIG. 3 is a cross-sectional view in an axial direction of an electric circuit breaker device according to another embodiment of the present invention.

(2) Electric Circuit Breaker Device illustrated in FIG. 3

An electric circuit breaker device 100 illustrated in FIG. 3 is practically the same as the electric circuit breaker device 1 illustrated in FIG. 1, except that a rod-like projectile 140, a cylindrical space 113, a cylinder 130, and a conductor portion 150 have different shapes.

A housing (resin housing) 110 made of synthetic resin includes the cylindrical space 113 that extends from a first end portion 111 to the conductor portion 150 on a side where a second end portion 112 is located. The cylindrical space 113 includes a large diameter cylindrical space 113*a* on the first end portion side and a small diameter cylindrical space 113*b* on the second end portion 112 side.

The rod-like projectile 140 includes a base portion 141 and a rod portion 145. The outer diameter of the base portion 141 is greater than the outer diameter of the rod portion 145. The cross-sectional shape of the base portion 141 in the housing width direction is a circle, and the cross-sectional shape of the rod portion 145 in the housing width direction is a quadrangle. The base portion 141 includes a first base portion 142 facing an igniter 120, a third base portion 144 in contact with the rod portion 145, and a second base portion 143 located between first base portion 142 and the third base portion 144. A surface 142*a* of the first base portion 142 on the igniter 120 side has a curved recessed surface that is deepest at the center and is configured to be more accommodating to the pressure generated when the igniter 120 actuates. The first base portion 142 and the third base portion 144 have a substantially similar outer diameter and are in contact with the inner circumferential surface of the cylinder 130. The outer diameter of the second base portion 143 is less than the outer diameter of the first base portion 142 and the third base portion 144, allowing for an O-ring 146 to be disposed in the annular space around the second base portion 143 formed by this difference in outer diameter.

The cylinder 130 is for reinforcing the housing 110 and can be made of a metal such as stainless steel or aluminum or a fiber reinforced resin such as carbon fiber reinforced resin. The cross-sectional shape of the cylinder 130 in the housing width direction is a circle. The cylinder 130 surrounds an ignition portion 121 of the igniter 120 and the projectile 140 and is forced into the cylindrical space 113, being fixed and unable to move in the axial direction. Several pairs of cut-out portions located at predetermined intervals are formed at a plurality of locations at equal intervals on the second end portion 130*a* side of the cylinder 130. The two cut-out portions located at predetermined intervals are bend inward and function at a guide portion 131 of the rod portion 145.

The conductor portion 150 is configured to form a portion of an electric circuit when the device 100 is part of an electric circuit. The conductor portion 150 is a plate portion including a first connection portion 151 and a second connection portion 152 at opposing ends and a cut portion 153 in an intermediate portion between the first connection portion 151 and the second connection portion 152. The first connection portion 151 and the second connection portion 152 are configured to connect to other conductors in the electric circuit (e.g., a lead wire). The cut portion 153 is configured to be cut and interrupt the electric circuit when activated.

The conductor portion 150 is disposed with a surface of the cut portion 153 orientated orthogonal to the axial direction of the housing 110. The surface of the cut portion 153 of the conductor portion 150 faces the end surface of the rod portion 145 of the projectile 140. In FIG. 3, the surface of the cut portion 153 and the end surface of the rod portion 145 are in contact with one another, but in another embodiment, the two may face each other with space in between.

An insulating closed space 161 is formed between the conductor portion 150 and the second end portion 112 of the housing. The insulating closed space 161 has a square cross-sectional shape in the housing width direction and includes an opening portion that opens to the conductor portion 150, a closed end surface 162 on the second end portion 112 side opposite from the opening portion in the housing axial direction, and four side surfaces 163.

A width (W1) of the insulating closed space 161 (space between opposing side surfaces 163) and a width (W2) of the rod portion 145 of the rod-like projectile 140 have the relationships W1>W2 and W1−W2≤0.25 mm. Preferably W1−W2≤0.20 mm, and more preferably W1−W2≤0.10 mm.

A method of manufacturing the electric circuit breaker device 100 illustrated in FIG. 3 includes placing the conductor portion in a mold and performing injection molding, then inserting the required components from one end of the cylindrical space 113. Another method include placing the conductor portion in a mold and performing injection molding, forming a first housing by inserting components up until the conductor portion 150 from the first end portion 111, inserting the required components from either end of the cylindrical space 113 and placing it back in the mold and performing injection molding again, and forming a second housing (bottom clip) from the portion up until the conductor portion 150 to the second end portion 112.

When the electric circuit breaker device 100 of FIG. 3 actuates, the conductor portion 150 is cut in a similar manner to that of the electric circuit breaker device 1 illustrated in FIG. 1. This action breaks the electric connection between the first connection portion 151 and the second connection portion 152 on either end of the conductor portion 150, and the electric circuit including the device 100 is interrupted. In the case where in this process the conductor portion 150 is cut and an arc is caused between the first connection portion 151 and the second connection portion 152, the arc is extinguished due to the rod portion 145 of the rod-like projectile 140 moving while sliding against the side surfaces 163 of the insulating closed space 161.

The electric circuit breaker device of an embodiment of the present invention can be used in various types of electric circuits including in an electric circuit including a battery (e.g., lithium ion battery) of a vehicle, an electric circuit of an electric vehicle, and an electric circuit of an electric home appliance, and is particularly suited to being used in an electric circuit of an electric vehicle.

The present invention has been described as above. Of course, the present invention includes various forms of modifications within the scope thereof, and these modifications do not depart from the scope of the invention. All of what a person with ordinary skill in the art will clearly consider as a variation of the present invention is within the scope of the claims set forth below.

The invention claimed is:

1. An electric circuit breaker device, comprising:

in a housing made of synthetic resin, an igniter, a rod-like projectile made of synthetic resin, and a conductor portion configured to form a portion of an electric circuit disposed in a cylindrical space formed in the housing in this order from a first end portion side toward a second end portion side opposite the first end portion side in a housing axial direction; and an insulating closed space formed between a second end portion of the housing and the conductor portion; wherein the conductor portion is a plate portion comprising a first connection portion and a second connection portion at opposing ends and a cut portion in an intermediate portion between the first connection portion and the second connection portion, a surface of the cut portion being orientated orthogonal to the housing axial direction;

the rod-like projectile is disposed aligned with a surface of the cut portion of the conductor portion in the housing axial direction; and a width (W1) of the insulating closed space and a width (W2) of an end portion of the rod-like projectile have relationships W1>W2 and W1−W2≤0.25 mm.

2. An electric circuit breaker device, comprising:

in a housing made of synthetic resin, an igniter, a rod-like projectile made of synthetic resin, and a conductor portion configured to form a portion of an electric circuit disposed in a cylindrical space formed in the housing in this order from a first end portion side toward a second end portion side opposite the first end portion side in a housing axial direction; and an insulating closed space formed between a second end portion of the housing and the conductor portion; wherein the conductor portion is a plate portion comprising a first connection portion and a second connection portion at opposing ends and a cut portion in an intermediate portion between the first connection portion and the second connection portion, a surface of the cut portion being orientated orthogonal to the housing axial direction;

the rod-like projectile is disposed aligned with a surface of the cut portion of the conductor portion in the housing axial direction; and a width (W1) of the insulating closed space from an opening portion to a closed end surface and a width (W2) of an end portion of the rod-like projectile have relationships $W1<W2$ and $W2/W1\leq1.05$.

* * * * *